United States Patent [19]

Epstein

[11] 4,389,907

[45] Jun. 28, 1983

[54] RELEASABLE HOOK

[76] Inventor: Irving Epstein, 4216 Shoreclub Dr., Mercer Island, Wash. 98040

[21] Appl. No.: 695,119

[22] Filed: Jun. 11, 1976

[51] Int. Cl.[3] ..... B63B 23/58; B66C 1/34

[52] U.S. Cl. ..... 74/529; 114/252; 294/83 R; 294/84

[58] Field of Search ..... 74/529, 532; 292/108; 294/75, 83 R, 83 A, 83 AB, 84; 24/232 R, 232 G, 233, 234, 235, 241 R, 241 P, 241 PP; 114/230, 252

[56] References Cited

U.S. PATENT DOCUMENTS

| | | | |
|---|---|---|---|
| 1,101,113 | 6/1914 | Attfield | 294/84 |
| 1,242,809 | 10/1917 | Irwin | 294/83 |
| 1,377,159 | 5/1921 | Spechtmeier | 294/84 |
| 2,310,018 | 2/1943 | Daalder | 74/529 |
| 2,359,275 | 9/1944 | Anderson | 294/83 |
| 2,858,161 | 10/1958 | Smith | 294/83 |
| 2,864,644 | 12/1958 | Marryatt | 294/83 |
| 2,896,995 | 7/1959 | Stephens | 294/83 |
| 3,054,635 | 9/1962 | Voss | 294/83 R |
| 3,259,418 | 7/1966 | Munday et al. | 294/83 R |
| 3,405,965 | 10/1968 | Hass | 294/83 |
| 3,436,795 | 4/1969 | Hill | 24/241 |
| 3,514,142 | 5/1970 | Smith | 292/108 |
| 3,610,674 | 10/1971 | Janssen | 294/83 R |
| 3,761,122 | 9/1973 | Epstein | 294/83 |
| 3,762,757 | 10/1973 | Epstein | 294/84 |
| 3,811,720 | 5/1974 | Epstein | 294/84 |
| 4,034,992 | 7/1977 | Epstein | 294/83 R |

FOREIGN PATENT DOCUMENTS

| | | | |
|---|---|---|---|
| 1130071 | 10/1968 | United Kingdom | 114/252 |
| 1295385 | 11/1972 | United Kingdom | 114/252 |

*Primary Examiner*—Daniel J. O'Connor
*Attorney, Agent, or Firm*—Thomas W. Secrest

[57] ABSTRACT

In the mooring of ships and boats to a dock or an oil well platform, it is necessary to have a line running from the ship or boat to the dock or platform. The line can be more or less tight and must be fixed so as to allow, relatively, sudden movements of the ship or boat with respect to the dock or platform. Then, when it is time for the ship or boat to sail away from the dock or platform, it is necessary to disengage the line from the fastening means from the dock or platform. This invention relates to a fastening means whereby a line can be positioned to the fastening means for securing the ship or boat adjacent to the dock or platform. Then, the person on the dock or platform can, by means of an electric control, if desirable, at a remote position from the fastening means, actuate the fastening means to allow the line to slip away from its fastening means and also to allow the ship or boat to sail away from the dock or platform. Further, if necessary, the fastening means can be actuated, manually, so as to allow the ship or boat to sail away from the dock or platform. This fastening means is identified as a releasable hook.

25 Claims, 9 Drawing Figures

RELEASABLE HOOK

THE BACKGROUND OF THE INVENTION

When a ship or a barge is in a harbor, it may be anchored in open water, or it may be secured to a pier or other stationary structure. Likewise, a ship at an oil well platform is secured to the platform. If the ship is anchored in open water or secured to the pier or platform, the ship or vessel's own gear is used. When securing to a pier of a platform, for example, the ship's lines are brought out from the ship and secured to various kinds of fittings on the stationary structure. The ship's line or vessel's line may have a loop or large eye, spliced into the end of the line which is brought from the ship and secured to the fitting on the stationary structure. Sometimes, both ends of the mooring line are retained aboard the ship and the bight of the line is brought out from the ship and secured to a fitting on the stationary structure. The fitting on the stationary structure may be a bollard, or it may be a sleeve, or it may be a pair of mooring bits, or the fitting on the stationary structure may be a releasable hook. This invention is directed to a releasable hook for retaining a mooring line. The hook may be opened or closed by hydraulic pressure under remote control. In the event of the failure of the power source to energize the hydraulic pressure controlling the hook, then the hook may be released manually.

THE GENERAL DESCRIPTION OF THE INVENTION

The release hook, a rotatable member, is locked into position with the bight of the line passing around the hook. There is a locking mechanism which prevents the release hook from rotating. When it is desired to release the mooring line from this release hook, it is possible to, quickly, release the line. The hook rotates to release the mooring line. The hook can be released under tension but cannot be released, accidentally. Line tension from the weight of the unloaded slack mooring line, or tension caused by the ship or vessel pulling away from the dock or platform, trips the hook completely. The hook then rotates and returns to the loading position. There is also provided a fail-safe interlock mechanism for manual release of the hook in the situation of a power failure or a failure in the hydraulic line.

THE OBJECTS AND THE ADVANTAGES

An important object of this invention is to provide a locking mechanism to prevent the movement of a rotatable member and, in particular, the movement of a rotatable hook; a further important object is to provide a remotely controlled mechanical release for said locking mechanism and a manual release for use, when necessary, with said locking mechanism; a further important object of this invention is to provide a releasable hook for use on a dock or pier or oil well platform having such a locking mechanism to prevent rotation of the hook until the desired time; another object is to provide a releasable hook with such a locking mechanism and which has a mechanical release or a manual release for allowing the hook to rotate, a further and important object is to provide a releasable hook with such a locking mechanism and which releasable hook has a large capacity such as 150 ton capacity; and, a further object is to provide such a releasable hook having electrical control and hydraulic control packaged in the mounting platform for the hook so as to provide, in essence, an integral structure for the hook and the control. These and other important objects and advantages of the invention will be more particularly brought forth upon reference to the detailed description of the invention, the appended claims and the accompanying drawings.

THE DRAWINGS

Figure 5:
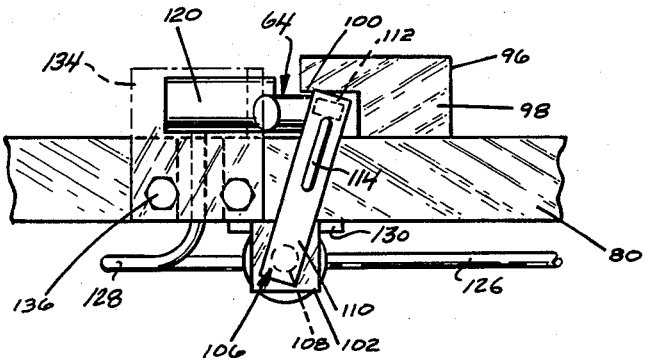
Figure 6:
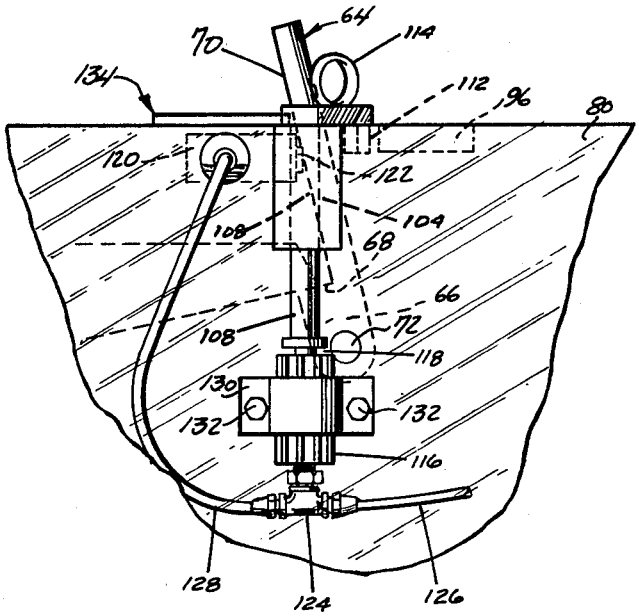
Figure 7:
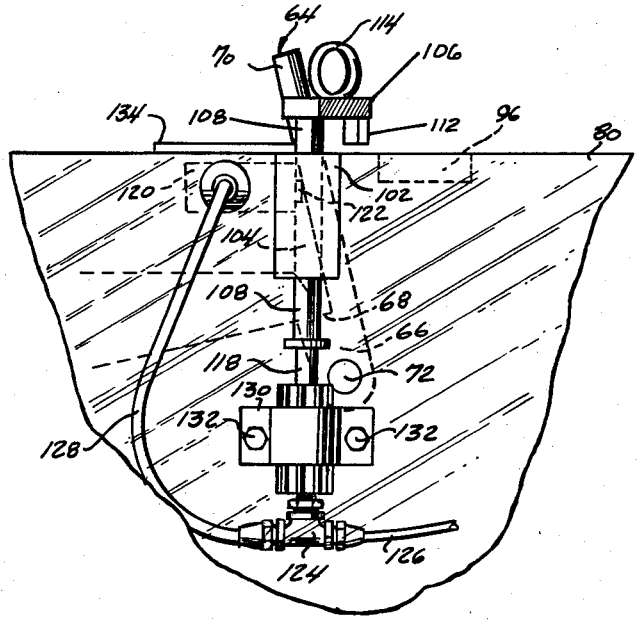
Figure 8:
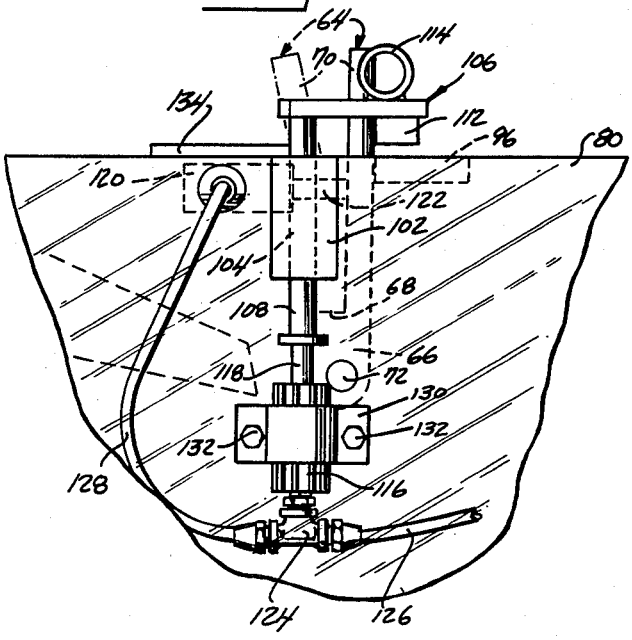
Figure 9:
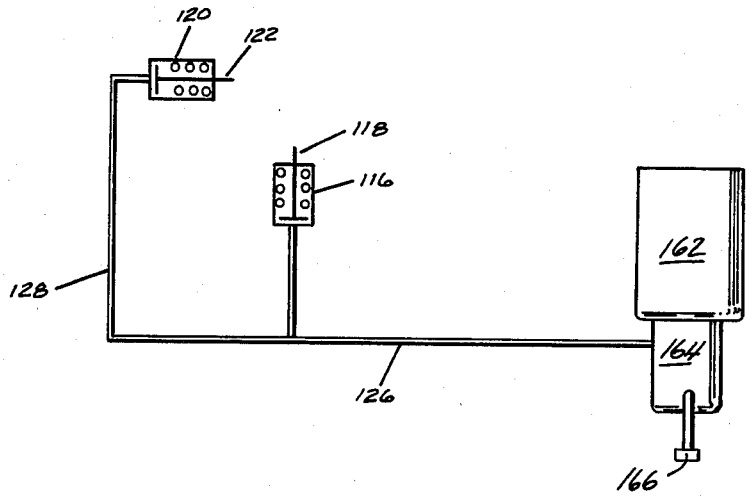

FIG. 5, on an enlarged scale, is a fragmentary plan view looking down on a safety catch for preventing movement of the locking mechanism and the unlocking of the releasable hook;

FIG. 6 is a fragmentary side elevational view illustrating the safety catch in position for preventing the locking mechanism becoming unlocked, FIG. 7 is a fragmentary side elevational view illustrating the safety catch is being removed so as to allow the locking mechanism to become unlocked, FIG. 8 is a fragmentary side elevational view illustrating the safety catch as having been elevated and away from the locking mechanism so as to allow the locking mechanism to become unlocked and to allow the releasable hook to rotate to release the mooring line; and FIG. 9 is a schematic illustration of the hydraulic system for removing the safety catch away from the release lever of the locking mechanism so as to allow the locking mechanism to become unlocked to allow the releasable hook to rotate for releasing the mooring line.

THE SPECIFIC DESCRIPTION OF THE INVENTION

In the drawings, there is illustrated a rotatable member 10 in the form of a hook having a base portion 12, a first leg 14, and a second leg 16. In the base 12 and where the legs 14 and 16 join, there is formed an interior curve 18. In the base 12 and on the outside of the curve at the junction of the legs 14 and 16, there is recessed a part of the base to form a shoulder 20.

On the inner and outer parts of the leg 16, there is a bearing surface 22.

There is a locking mechanism for locking the rotatable member 10 in a fixed position.

The locking mechanism comprises a stop 24, preferably, in the form of a roller, mounted on a shaft 26. The shaft 26 is mounted on a pawl 28. The pawl 28 comprises a first leg 30 and a second leg 32. The first leg 30 and the second leg 32 are, approximately, at right angles to each other. The pawl 28, at the junction of the first leg 30 and the second leg 32, is mounted on a shaft 34.

On the outer part of the first leg 30, there is a base 36 which connects with a spaced apart support 38 which overlies the upper part of the first leg 30. The shaft 26 is mounted in the upper part of the first leg 30 and also in the spaced apart support 38. The spacing between the upper part of the first leg 30 and the spaced apart support 38 is sufficient to receive and accommodate the outer part of the second leg 16 of the rotatable member 10.

The pawl 28 can rotate around the shaft 34. Also, the stop 24 can rotate on the shaft 26.

Near the outer end of the second leg 32 and on that side away from the spaced apart support 38, there is a shaft or cam follower 40.

There is a cam plate 42 mounted on a pin or shaft 44. The cam plate 42 is capable of rotating on said pin or shaft 44. The cam plate 42 has a cam slot comprising a long slot 46, substantially, vertical, and a short slot 48, substantially at a right angle to the slot 46. The slot 46 and the slot 48 give the appearance of an L. The cam follower 40 is capable of moving in said cam slots 48 and 46.

Figure 3:
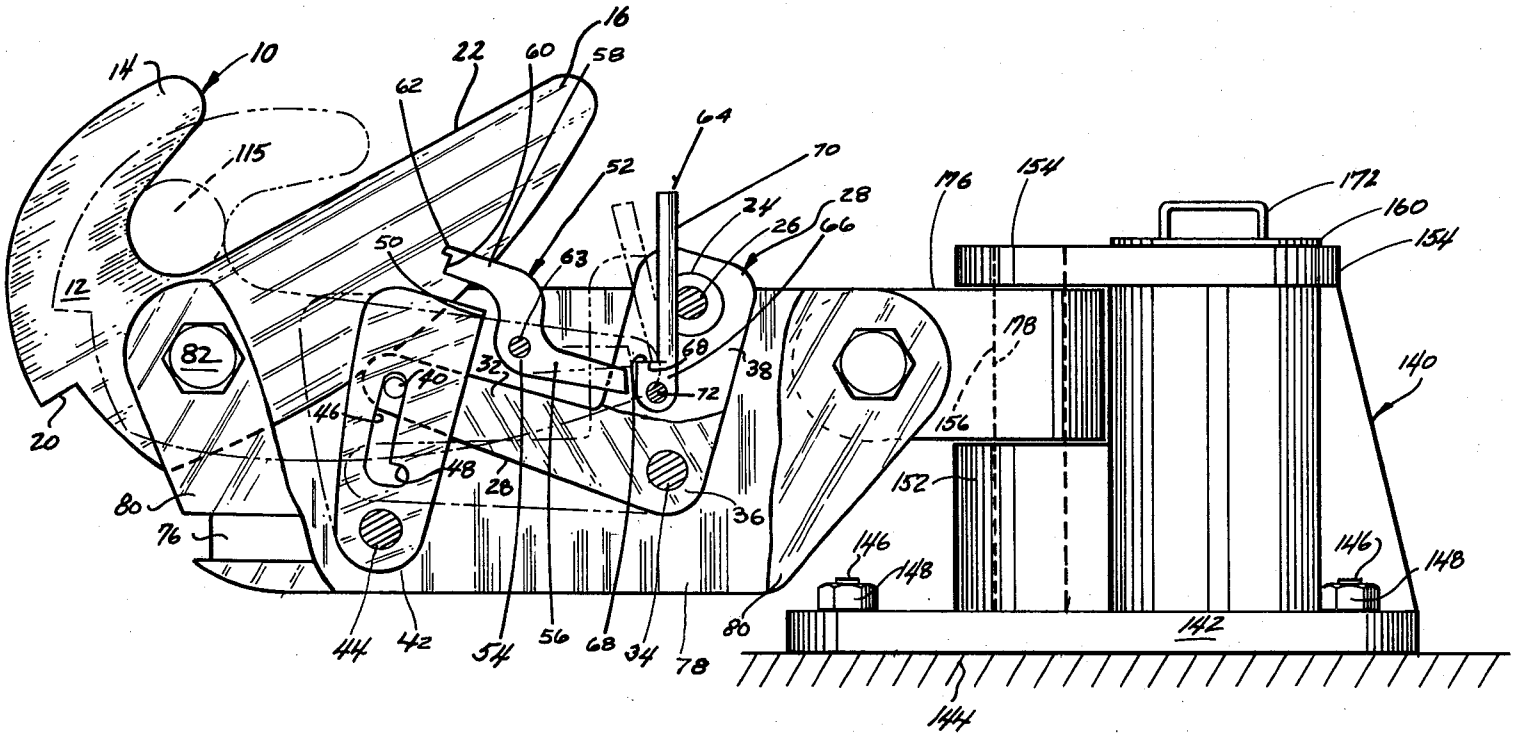
FIG. 3 is a fragmentary side elevational view illustrating the locking mechanism as having been unlocked or released to allow the releasable hook to rotate so as to assume a position permitting the mooring line to escape from the hook.

The cam plate 42 has a bearing surface 50 on its upper right area, see FIG. 3.

There is a balance lever 52 in the general configuration of an S having a central portion 54, a first leg 56, and a second leg 58. On the outer end of the second leg 58, there is a bearing surface 60 and also a locking lug 62. The balance lever 52 is capable of rotating on shaft 63.

There is a release lever 64 having a base 66 and which base, on its upper part, has a bearing ledge 68. There is a handle 70 connecting with the base 66. Also, the base 66 is mounted on a shaft 72 and which base can rotate on this shaft.

Figure 1:
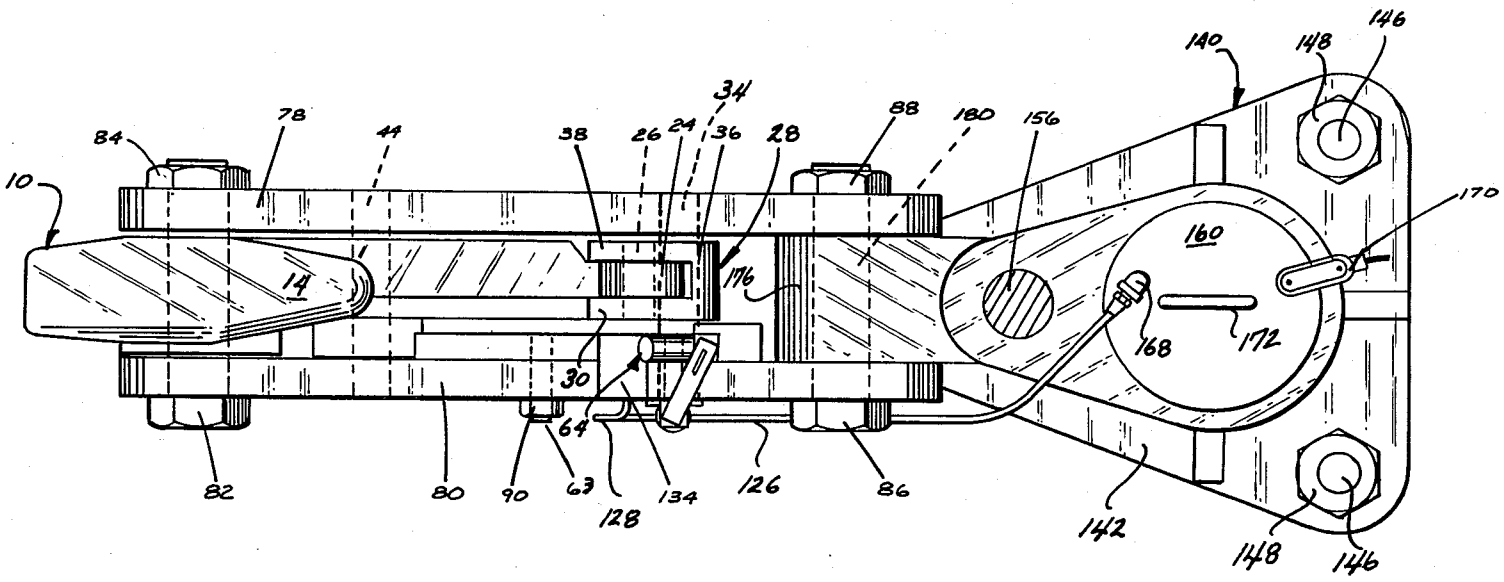
FIG. 1 is a top plan view illustrating the releasable hook, the locking mechanism, and the controls for the locking mechanism.
Figure 2:
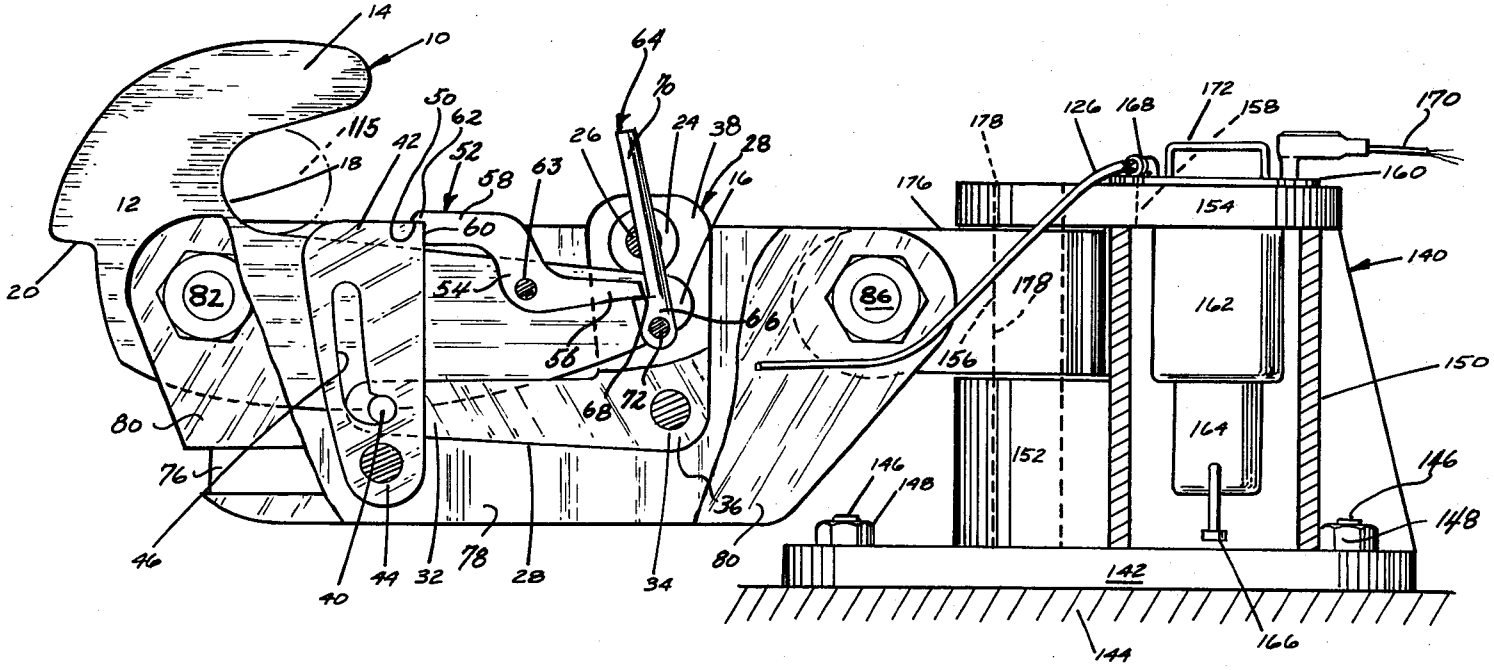
FIG. 2 is a fragmentary side elevational view, partly, in cross section illustrating the locking mechanism for controlling the movement of the rotatable hook and with the hook being in a locked position.

The operation of this locking mechanism with respect to the rotatable member 10 or hook 10 is explained as follows in conjunction with the drawings. FIG. 1 is a top plan view showing the rotatable member 10 being locked in position. In FIG. 2, it is seen that the rotatable member 10 is locked in position with the second leg 16 bearing against the stop 24. The cam follower 40 is in the short leg 48 in the cam slot of the cam plate 42. The balance lever 52 is bearing against the cam plate 42 at the area 50. Also, the locking lug 62 prevents the balance lever 52 from, (see FIG. 2) rotating counterclockwise or downwardly against the cam plate 42. Then, there is a release lever 64 whose bearing ledge 68 bears against the lower outside part of the first leg 56 of the balance lever 52. With the release lever 64 in the position as illustrated, it is not possible for the balance lever 52 to rotate so as to allow the cam plate 42 to rotate so as to allow the cam follower 40 to move in the cam slots 48 and 46 so as to allow the pawl 28 to rotate to move the stop 24 away from the second leg 16 in the rotatable member 10 so as to allow said rotatable member 10 to rotate, see FIG. 2, in a counterclockwise direction.

In FIG. 3, there is illustrated the release lever 64 as having been moved in a clockwise direction so that the bearing ledge 68 no longer bears against the lower part of the first leg 56. Then, the balance lever 52 is capable of rotating in a clockwise direction so as to remove the bearing surface 60 away from the bearing surface 50 of the cam plate 42. This permits the cam plate 42 to rotate so that the cam follower 40 can move in the cam slots 48 and 46 to allow the pawl 28 to rotate in a clockwise direction to move the stop 24 away from the second leg 16 of the rotatable member 10. In FIG. 3, it is seen that the rotatable member 10 is rotating in a counterclockwise direction.

Figure 4:
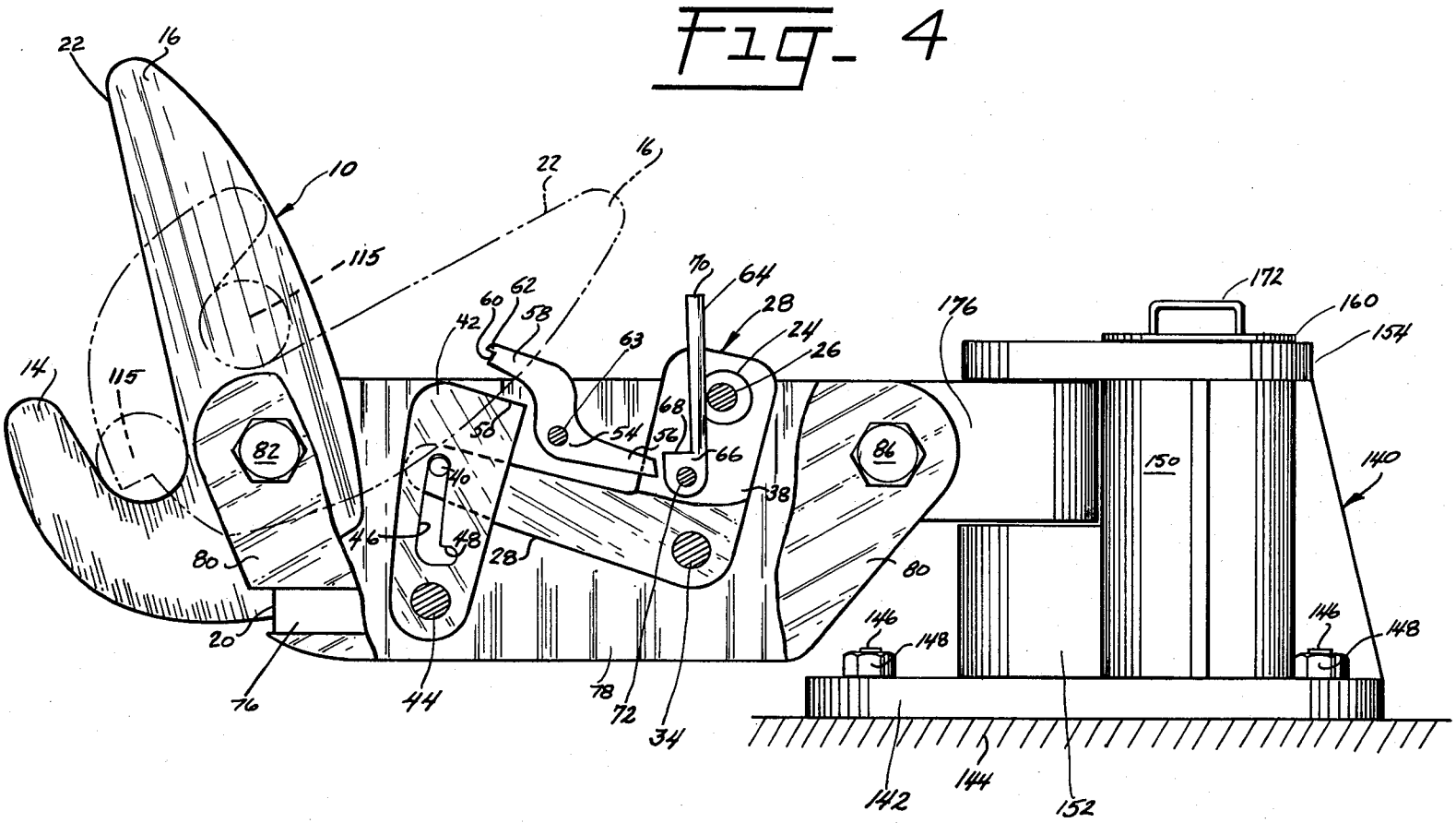
FIG. 4 is a fragmentary side elevational view illustrating the locking mechanism as being unlocked and with the releasable hook as having rotated as far as it can possibly rotate so as to strike a bumper pad.

Now, with respect to FIG. 4, it is seen that the rotatable member 10 has rotated in a counterclockwise direction so that the shoulder 20 is bearing against a bumper pad 76 in the lower left portion.

From the foregoing, it is seen that with the locking mechanism in a locked position and the rotatable member 10 locked in position, that it is possible to unlock this locking mechanism by moving the release lever 64 in a rotatable clockwise direction. Then, the rotatable member 10 is free to rotate in a counterclockwise direction.

There is a support frame for mounting the hook 10 and the locking mechanism. In FIG. 1, it is seen that there is a first frame member 78 and a second frame member 80. In FIG. 1, it is seen that at the left end there is a bolt 82 joining the two frame members 78 and 80 and also extending through the base portion of the U-shaped hook 10. The U-shaped hook 10, or rotatable member 10 is capable of rotating on the bolt 82. Naturally, there is a nut 84 screwed onto the threaded end of the bolt 82 for holding the bolt 82 in position. In FIG. 1, it is seen that at the other end of the two frame members 78 and 80 there is a bolt 86 which passes through these two frame members and that there is a nut 88 screwed onto the threaded end of the bolt 86 so as to hold together the two frame members.

The pin or shaft 44 on which the cam plate 42 is mounted connects with the two frame members 78 and 80. Also, the balance lever 52 rotates on the shaft 63 which is positioned on the frame member 80. The shaft 63 is threaded on its outer end and there is a nut 90 on the threaded outer end for positioning the shaft 63.

There is a safety catch to prevent the accidental release of the release lever 64 when the rotatable member 10 or U-shaped hook 10 is in a locked position.

In FIG. 5, there is a fragmentary plan view illustrating this safety catch.

On the inside upper surface of the second frame member 80, there is a stop block 96 having an enlarged base portion 98 and an outstanding ledge 100. In FIG. 5, it is seen that the ledge 100 is spaced apart from the second frame member 80 a sufficient distance to allow the release lever 64 to rotate between the ledge 100 and the second frame member 80.

On the outside of the second frame member 80, there is a guide block 102 having a center bore 104. A safety catch 106 having a depending rod 108 is positioned in the guide block 102. More, particularly, the depending rod 108 is positioned in the center bore 104 and the safety catch has a cross member 110 connecting with the upper part of the depending rod 108. The cross member 110, on its other end, also has a depending rod 112.

In FIGS. 5 and 6, it is seen that the depending rod 108 is on the outside of the frame member 80 and that the depending rod 112 is on the inside of the frame member 80 and that the depending rod 112 is in that space between the ledge 100 and the frame member 80 so as to lock into position the release lever 64 and to prevent rotation of the release lever 64.

It is seen that positioned on the upper part of the cross member 110, there is grasping ring 114.

To unlock the locking mechanism, it is necessary to move the release lever 64. However, with the release lever 64 locked in position and with the safety catch 106 so positioned as to restrict the movement of the release lever 64, it is not possible to unlock the locking mechanism. One way of unlocking the locking mechanism is by a person taking hold of the ring 114 and lifting the cross member 110 upwardly and the depending rod 112 from between the ledge 100 and frame member 80, see FIG. 7. Then, see FIG. 8, the cross member 110 and the depending rod 112 can be rotated away from the release lever 64. The release lever 64 can be, manually, moved to the right or rotated in a clockwise direction, see FIG. 8. This releases the balance lever 52 so as to allow the rotatable member 10 or the U-shaped hook 10 to rotate in a counterclockwise direction to release a mooring line 115.

In addition to the manual movement of the safety catch 106, there is also a remotely controlled mechanical system for removing the safety catch 106 to allow the release lever 64 to rotate to unlock the locking mechanism. In FIGS. 1, 5, 6, 7, 8, and 9, there is illustrated a fluid actuated system comprising a cylinder 116 having a ram 118 and a cylinder 120 having a ram 122. There is a T 124 which connects with a tube 126. Also, the T 124 connects with the cylinder 116 and connects with the tube 128. The tube 128 connects with the cylinder 120. Again, referring to FIGS. 5 and 6, it is seen that safety catch 106 is positioned to prevent rotation of the release lever 64. Upon actuation of the cylinder 116, the ram 118 is extended to contact the bottom of the depending rod 108. The depending rod 108 is elevatated so as to elevate the safety catch 106 upwardly and away from the release lever 64. Substantially, simultaneously, the cylinder 120 is actuated so as to extend the ram 122. The ram 122 contacts the handle 70 of the release lever 64 so as to rotate the release lever 64 in a clockwise manner and to rotate the bearing ledge 68 away from the balance lever 52 to allow the locking mechanism to come unlocked and to allow the rotatable member 10 to rotate.

There is a bracket 130 for positioning the cylinder 116 by means of bolts 132 to the outside of the frame member 80. Also, there can be a support 134 welded onto the top of the frame member 80 and which support 134 supports the cylinder 120. Or, the support 134 can be attached to the top of the frame member 80 by means of bolts 136.

There is a support 140 for the releasable hook and which support comprises a base 142 which may be of a, generally, triangular configuration. This base may be mounted onto a dock or a pier or an oil well platform 144 by means of threaded rods 146 and bolts 148.

The support 140 comprises an upright tubular housing 150.

As part of the support 140, there is an adapter support 152. There is also a top plate 154 which covers the upright tubular housing 150 and is positioned above the adapter support 152. There is positioned by the adapter support 152 in the top plate 154, a center pin 156.

In the top plate 154, there is an opening 158. There is positioned over this opening 158 a mounting plate 160. The periphery of the mounting plate 160 is larger than the opening 158 so that the mounting plate cannot fall into the interior of the tubular housing 150.

The mounting plate 160 is a support for an electric motor 162. The electric motor 162 is attached to or positioned onto the mounting plate 160. The electric motor 162 connects with a pump 164. There is attached to the pump 164, a filter 166. The fluid line 126 connects with the pump 164 and electric motor 162 combination by means of an adapter 168. There is an electric line 170 which connects with the electric motor 162 through the mounting plate 160. On top of the mounting plate 160, there is a bracket 172 integral with the mounting plate. The reader can see that it is possible to grasp onto the bracket 172 and raise the mounting plate 160 and also the electric motor 162, the pump 164, and the filter 166 out of the tubular housing 150. The fluid actuated system comprising the cylinders 116 and 120 and the pump 164 make it possible, at a remote position, to elevate the safety catch 106 so as to release the release lever 64 to unlock the locking mechanism for rotation of the rotatable U-shaped hook 10. This feature is of value with respect to an oil well platform. Quite often, the releasable hook is positioned at an inaccessible place on the oil well platform. When it comes time to release the mooring line 115, attached to a ship or a barge, it is desirable and preferable to, remotely, actuate the locking mechanism so as to unlock this locking mechanism to allow the U-shaped hook 10 to rotate to release the mooring line 115. Again, there has been provided a manual means for removing the safety catch 106 to allow the release lever 64 to rotate to unlock the locking mechanism, if the necessity occurs.

There is an adapter 176 having the general configuration of a rectangular parallelopiped piece of metal. In this adapter 176, there is an upright passageway 178 for receiving the center pin 156. It is seen that this portion of the adapter 176 is positioned between the adapter support 152 and the top plate 154. Also, in the adapter 176 there is horizontal passageway 180. The bolt 86 passes through this horizontal passageway 180 so as to attach the frame members 78 and 80 to the adapter 176.

From this, it is seen that the adapter 176 connects the frame members 78 and 80 to the support 140. Also, the frame members 78 and 80 and the locking mechanism and the releasable U-shaped hook 10 can rotate in a first plane around the bolt 86. Further, the member 176 and the frame members 78 and 80 and the locking mechanism and the U-shaped hook 10 can rotate in a second plane around the center pin 156. The first plane and the second plane are, substantially, at right angles to each other so as to give considerable freedom of rotation or freedom of movement to the U-shaped hook 10 and its associated components, with respect to the support 140.

As, previously, stated, there is a bumper pad 76 positioned between the frame members 78 and 80 in a recess in the frame member. The U-shaped hook 10, upon rotating counterclockwise, contacts this bumper pad 76 with the shoulder 20 so as to lessen the shock and stress on the frame members 78 and 80 and the locking mechanism. Further, the U-shaped hook, upon hitting the bumper pad 76, tends to bounce back and rotate in a clockwise direction so as to assume a locked position for receiving the next mooring line 115.

An invention to be patentable must be new, useful, and unobvious. 35 U.S.C. 101 states:

> "Whoever invents or discovers any new and useful process, machine, manufacture, or composition of matter, or any new and useful improvement thereof, may obtain a patent therefor, subject to the conditions and requirements of this title."

I consider the subject invention to be new as I know of no other locking mechanism similar to the present locking mechanism and also I know of no other releasable hook using this locking system and unlocking mechanism. Also, there is a provision for the manual unlocking of this mechanism and a remote control unit for unlocking this mechanism to allow the releasable hook to rotate and release the mooring line.

I consider the invention to be useful as it can be used on a pier, dock, oil well platform, and the like for mooring ships and barges. The releasable hook can be made in a large capacity for mooring large ships and barges.

35 U.S.C. 103 states;

"A patent may not be obtained though the invention is not identically disclosed or described as set forth in section 102 of this title, if the differences between the subject matter sought to be patented and the prior art are such that the subject matter as a whole would have been obvious at the time the invention was made to a person having ordinary skill in the art to which said subject matter pertains. Patentability shall not be negatived by the manner in which the invention was made."

I consider the subject invention to be unobvious as I know of no prior art showing this locking mechanism and a releasable hook employing this locking mechanism. There are other releasable hooks, but, to the best of my knowledge, none of these other releasable hooks teach structure of this hook and the mechanism of this hook for locking a rotatable member in position and also for unlocking the rotatable member so as to release the mooring line.

There have come to my attention some patents relating to releasable hooks. These patents are:

| PATENT NO. | PATENTEE | DATE |
|---|---|---|
| 1,101,113 | Attfield | 6/1914 |
| 1,242,80 | Irwin | 10/1917 |
| 1,377,159 | Spechtmeier | 5/1921 |
| 2,359,275 | Anderson | 9/1944 |
| 2,858,161 | Smith | 10/1958 |
| 2,854,644 | Maryatt | 12/1958 |
| 2,896,995 | Stephens | 7/1959 |
| 3,054,635 | Voss | 9/1962 |
| 3,405,965 | Haas | 10/1968 |
| 3,436,795 | Hill | 4/1969 |
| 3,610,674 | Janssen | 10/1971 |

From the foregoing, and having presented my invention, what I claim is:

1. A locking mechanism comprising:

a. a rotatable member;

b. a stop;

c. said stop being mounted on a pawl;

d. said pawl being movable to move said stop for engagement and disengagement with said rotatable member;

e. a cam plate;

f. said cam plate being movable;

g. a cam follower on said pawl for following the movement of said cam plate;

h. a balance lever;

i. said balance lever having a bearing surface for bearing against said cam plates;

j. said balance lever being movable;

k. a release lever;

l. said release lever having a bearing surface for bearing against said balance lever;

m. said release lever being distinct and separate from said balance lever;

n. said balance lever and said release lever may move to be juxtapositioned to each other; and, o. said release lever being movable for moving away from said balance lever to allow said balance lever to allow said cam plate to move to allow said pawl and said stop to move away from said rotatable member to allow said rotatable member to rotate.

2. A locking mechanism according to claim 1, and comprising:

a. said rotatable member positioning an element.

3. A locking mechanism, according to claim 1, and comprising:

a. a safety catch;

b. said safety catch being juxtapositioned to said release lever to restrict movement of said release lever; and, c. said safety catch being movable to be moved away from said release lever to allow said release lever to move.

4. A locking mechanism according to claim 3, and comprising:

a. said pawl being rotatable;

b. said cam plate being rotatable;

c. said balance lever being rotatable; and, d. said release lever being rotatable.

5. A locking mechanism according to claim 4, and comprising:

a. said safety catch being manually movable.

6. A locking mechanism according to claim 4, and comprising:

a. a mechanism for moving said safety catch; and, b. said mechanism comprising a plunger.

7. A releasable hook, said releasable hook comprising:

a. a frame;

b. a, generally, U-shaped hook having a first leg and a second leg;

c. a first means mounting said U-shaped hook on said frame so as to allow said hook to rotate with respect to said frame;

d. a stop;

e. said stop being mounted on a pawl;

f. said pawl being movable to move said stop for engagement and disengagement with said first leg of said U-shaped hook;

g. a cam plate;

h. said cam plate being moveable;

i. a cam follower on said pawl for following the movement of said cam plate;

j. a balance lever;

k. said balance lever having a bearing surface for bearing against said cam plate;

l. said balance lever being movable;

m. a release lever;

n. said release lever being distinct and separate from said balance lever;

o. said balance lever and said release lever may move to be juxtapositioned to each other; and, p. said release lever being movable for moving away from said balance lever to allow said balance lever to allow said cam plate to move to allow said pawl and said stop to move away from said first leg to allow said U-shaped hook to rotate.

8. A releasable hook according to claim 7 and comprising:

a. a safety catch;

b. said safety catch being juxtapositioned to said release lever to restrict movement of said release lever; and, c. said safety catch being movable to be moved away from said release lever to allow said release lever to move.

9. A releasable hook according to claim 8, and comprising:
a. said pawl being rotatable;
b. said cam plate being rotatable;
c. said balance lever being rotatable; and,
d. said release lever being rotatable.

10. A releasable hook according to claim 9 and comprising:
a. said safety catch being manually movable.

11. A releasable hook according to claim 9 and comprising:
a. a mechanism for moving said safety catch; and,
b. said mechanism comprising a plunger.

12. A releasable hook according to claim 7 and comprising:
a. a stop block; and,
b. a safety catch associated with said stop block for controlling movement of said release lever.

13. A releasable hook according to claim 12 and comprising:
a. a means for moving said safety catch away from said stop block to allow said release lever to move.

14. A releasable hook according to claim 13 and comprising:
a. a movable plunger for moving said safety catch away from said stop block to allow said release lever to move.

15. A releasable hook according to claim 13 and comprising:
a. a clasping means on said safety catch for allowing manual movement of said safety catch.

16. A releasable hook according to claim 7, and comprising:
a. said U-shaped hook having a shoulder; and,
b. a bumper lock plate positioned to be in the path of travel of said shoulder to stop the movement of said U-shaped hook.

17. A releasable hook according to claim 7, and comprising:
a. a support pedestal having a cavity and functioning as a housing;
b. a fluid control mechanism in said cavity; and,
c. said fluid control mechanism assists in controlling said release lever.

18. A releasable hook according to claim 7 and comprising:
a. an adapter; and,
b. a means for mounting said frame onto said adapter for allowing said frame and said adapter to rotate with respect to each other in a first plane.

19. A releasable hook according to claim 18, and comprising:
a. an adapter support;
b. said adapter being mounted on said support for allowing said adapter to rotate in a second plane; and,
c. said first plane and said second plane being, substantially, at right angles to each other.

20. A releasable hook according to claim 19, and comprising:
a. a stop block; and,
b. a safety catch associated with said stop block for controlling movement of said release lever.

21. A releasable hook according to claim 20, and comprising:
a. a means for moving said safety catch away from said stop block to allow said release lever to move.

22. A releasable hook according to claim 21, and comprising:
a. a movable plunger for moving said safety catch away from said stop block to allow said release lever to move.

23. A releasable hook according to claim 22, and comprising:
a. a support pedestal having a cavity and functioning as a housing;
b. a fluid control mechanism in said cavity; and,
c. said fluid control mechanism assists in controlling said release lever.

24. A releasable hook according to claim 23 and comprising:
a. said fluid control mechanism connecting with said movable plunger for controlling movement of said movable plunger.

25. A releasable hook according to claim 24 and comprising:
a. said U-shaped hook having a shoulder; and,
b. a bumper lock plate positioned to be in the path of travel of said shoulder to stop the movement of said U-shaped hook.

* * * * *